United States Patent [19]

Denton

[11] 4,287,639

[45] Sep. 8, 1981

[54] DOOR CLOSER PERMITTING FREE-SWING AND REGULAR-CLOSER MODES

[75] Inventor: Arthur M. Denton, Charlotte, N.C.

[73] Assignee: Scovill Inc., Waterbury, Conn.

[21] Appl. No.: 24,721

[22] Filed: Mar. 29, 1979

[51] Int. Cl.[3] ..... E05F 15/20; E05F 1/00; E05F 3/04

[52] U.S. Cl. ..... 16/48.5; 16/51; 16/71

[58] Field of Search ..... 16/48.5, 49, 51, 66, 16/71, 79, 82

[56] References Cited

U.S. PATENT DOCUMENTS

| | | | |
|---|---|---|---|
| 1,011,287 | 12/1911 | Voight | 16/49 |
| 1,816,392 | 7/1931 | Moore | 16/48.5 |
| 2,314,544 | 3/1943 | Larson | 16/49 |
| 2,851,719 | 9/1958 | Bernhard | 16/49 |
| 3,178,759 | 4/1965 | Patriquin et al. | 16/79 |
| 4,050,114 | 9/1977 | Zunkel | 16/48.5 |
| 4,102,005 | 7/1978 | Schnarr et al. | 16/49 |

*Primary Examiner*—Wm. Carter Reynolds
*Attorney, Agent, or Firm*—Dallett Hoopes

[57] ABSTRACT

Door closer of the type which holds the door open until an associated electric circuit is opened or closed. Provides means for free swinging of the door when the door closer is "cocked". This is achieved by a drive plate interposed between the closer shaft and its operator arm. The plate provides a pair of apertures which may selectively retain a pin adapted to work against the closer arm.

6 Claims, 10 Drawing Figures

CLOSER COCKED
FREE-SWING MODE

CLOSER COCKED
FREE-SWING MODE

CLOSER COCKED
REGULAR-CLOSER MODE

CLOSER COCKED
REGULAR-CLOSER MODE

DOOR CLOSER PERMITTING FREE-SWING AND REGULAR-CLOSER MODES

BACKGROUND OF THE INVENTION

1. Field of the Invention

The present invention relates to a door closer assembly and, more particularly, to a mounting for a door closer arm which permits the associated door both free-swing and regular-closer modes of operation.

2. Description of the Prior Art

In the prior art, there are disclosed a number of door closers of the electro-mechanical type wherein the closer, once the door is in open position, does not close the door until the activation or deactivation of an associated electric circuit. Such a circuit may be controlled manually, or automatically, as by a smoke detector.

Closers of this sort are well disclosed in prior patents such as U.S. Pat. No. 4.050,114, issued Sept. 27, 1977 to Richard L. Zunkel and U.S. Pat. No. 3,852,846, issued Dec. 10, 1974 to Loren E. Slaybaugh. Such closers generally comprise a cylinder containing a piston connected to the door by an operating arm. The piston in such a unit is spring-biased for movement in a direction which tends to close the door and such movement is opposed by an oil system which is relaxed only upon the opening of a solenoid valve.

More specifically, the door is opened manually thereby "cocking" the closer by winding back the door operator arm and moving the piston to compress the spring. The operator arm remains in the cocked position until the solenoid valve is opened as by an interruption in its electric supply. The opening of the solonoid valve, of course, permits the oil to flow in the closer and allows the spring bias to move the piston in the door-closing direction to close the door.

The closers disclosed in the above-mentioned patents are especially well adapted for use in nursing homes and hospitals to control metal doors of considerable weight and ruggedness.

In the past, because it is sometime desirable to close the door at will, provision has been made for overcoming or rendering ineffective the solenoid valve to permit the door closer to close the door. In the Zunkel and Slaybaugh closers, the provision has involved "momentary release pressure" usually ascomplished by the patient or nurse in pulling or pushing the door forcibly toward a closed direction. Once the initial closing force is used, the remainder of the closing is accomplished under minimum pressure. In re-opening the door, however, it is once again necessary to "re-cock" the door closer. The exertion required by the "momentary release pressure" and re-cocking of the closer has been a considerable obstacle especially for a debilitated patient. There has thus been a desire to keep the door closer in its cocked condition but to simply disengage or nullify the closer to permit the "free wheeling" or unimpeded swinging of the door.

One attempt to satisfy this desire is disclosed in the U.S. Pat. No. 4,034,437 to Lyman H. Robertson et al, issued July 12, 1977. In this arrangement, the arm is not attached to the door and remains in the cocked position out from the wall. When activated, the arm, which has a downward finger, swings encountering the door and eventually bringing it closed. Such prior arrangements, however, have been aesthetically repelling and objectionable in that they cause the door to "bounce" ahead of the arm when the arm is actuated.

SUMMARY OF THE INVENTION

The requirement for the apparatus to fill the above set forth desire is complicated by the fact that it should be non-handed, adapted for doors opening from left or right. Very preferably, the desired device should be simple, rugged and aesthetically pleasing. It should require no modification of the closer and be adapted to fit onto and convert closers already constructed.

The present invention fulfills exactly these demanding specifications. It is embodied in a driving plate adapted to be interposed between the drive shaft of the closer and the closer operating arm. The drive plate comprises means to attach itself in a perpendicular plane to the closer shaft and provides, outward from the axis of the shaft, a pair of spaced apertures adapted selectively to receive a pin which may be placed on the hinge side of the operating arm to abut the arm and drive it yet permit free swing of the door when the closer is in the cocked position. Alternatively, the pin can pass through an aperture in the operator arm to trap the arm so that it swings as a unit with the drive plate in a regular closer mode. The arrangement is non-handed

BRIEF DESCRIPTION OF THE DRAWINGS

Additional objects and features of the invention will be apparent to those skilled in the art from a review of the following specification and appended drawings, all of which disclose a non-limiting form of the invention. In the drawings.

DESCRIPTION OF THE PREFERRED EMBODIMENT

Figure 1:
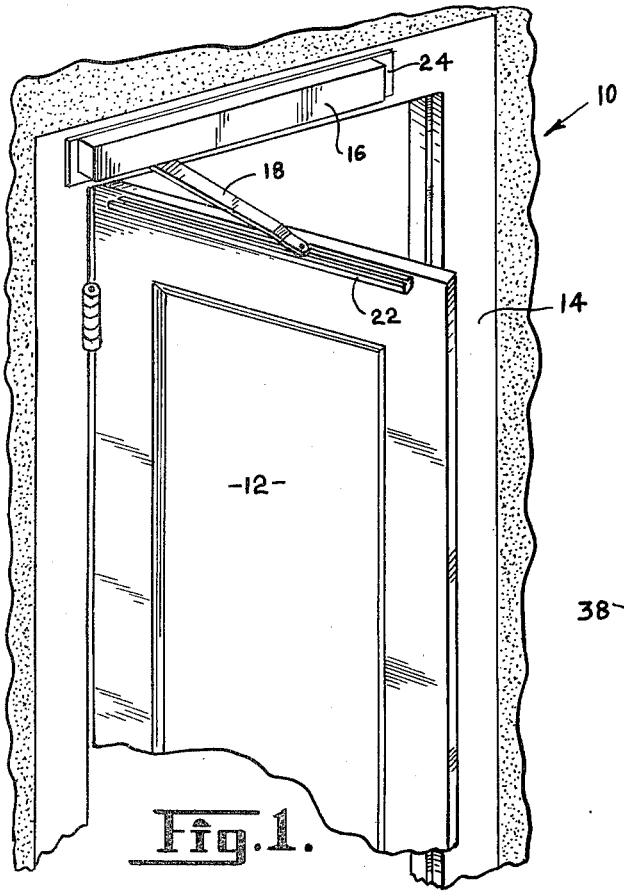
FIG. 1 is a perspective view of a closer embodying the invention applied to a door.
Figure 2:
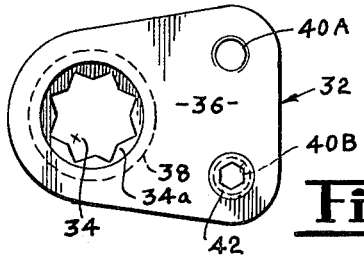
FIG. 2 is a greatly enlarged top plan view of a drive plate in accordance with the invention.

A door in which an apparatus embodying the invention has been installed is shown in FIG. 1 and generally designated 10. It includes the door proper 12 and the frame including the marginal trim 14. The door shown is hinged at its left-hand side. Mounted on the trim above the door is a housing 16 containing the door closer of the invention. The door closer includes an operating arm 18, the outer end of which terminates in a roller 20 which rides in a track 22 (FIG. 5) mounted on the door.

Figure 5:
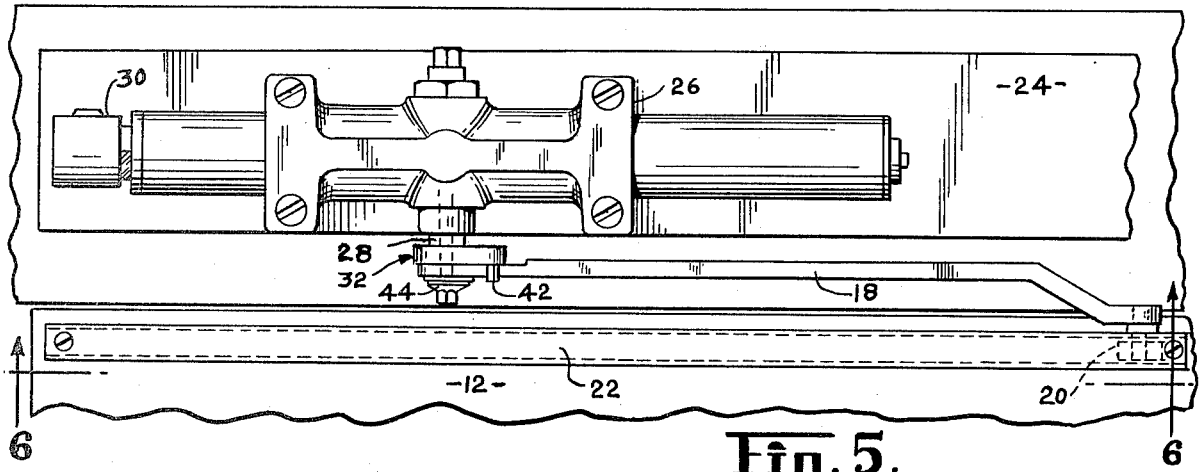
FIG. 5 is an elevational view of a portion of a door closer embodying the invention.

FIG. 5 shows the door closer with its housing 16 removed. It comprises a base plate 24 to which is secured the closer body 26. The body 26 encloses a piston having a rack portion which meshes with a pinion (all not shown) within the body and mounted on a drive shaft 28. Within the body the piston is biased by spring means (not shown) tending to drive the shaft 28 in rotation to cause the arm 18 to close the door. The movement of the piston by the spring is opposed by an oil system, the flow of which is controlled by a solenoid 30 by means which are well described in the art.

The output shaft 28 of the closer may be square in transverse cross section and is engaged at its lower end by a drive plate 32 which receives the squared end of the shaft through its opening 34. As shown, the opening may have a plurality, for instance, 8, of internal corners so as to give a number of different dispositions of the drive plate, for instance, 8, with respect to the shaft. In some versions, the relationship between the squared output shaft and the opening 34 may be as well described in the U.S. Pat. No. 3,909,876, issued Oct. 5, 1975, also to Richard L. Zunkel.

As shown, the drive plate 32 comprises a substantial metal flat lobe-like body 36. The opening 34 at one end of the lobe is surrounded downwardly by collar 38 and includes an annular recess above the internal-gear-like section to provide a bearing shoulder 34*a*.

At the corners of the other end of the plate 32 from the opening 34 are a pair of spaced threaded openings 40A and 40B which selectively receive a pin 42 threaded at the end which is received into the openings 40A and 40B so as to firmly secure the pin 42 in position. The non-threaded end of the pin 42 extends in the same direction as the collar 38.

Figure 3:
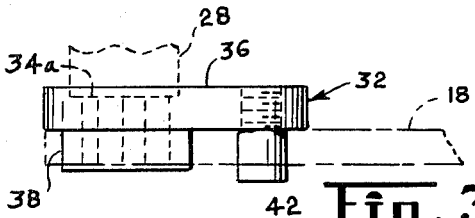
FIG. 3 is an elevational view of the drive plate showing adjacent parts in phantom.
Figure 4:
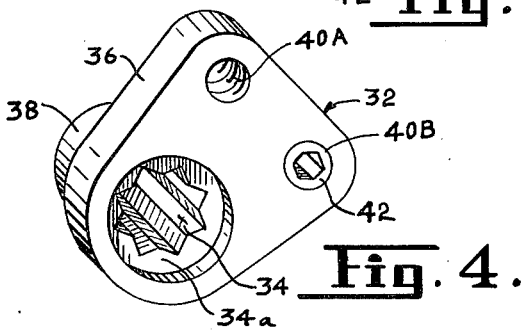
FIG. 4 is a perspective view of the drive plate.

The drive plate 32 is installed on the shaft 28 in proper position by having the square end of the shaft 28 fit into selected corners of the opening 34, the shoulder 34*a* butting up against the adjacent metal of the shaft 28 (see FIG. 3). The arm 18, having an enlarged opening, is then fitted over the collar 38 (FIG. 5) and a washer and bolt 44 is threaded into a tapped opening in the end of the shaft 28 to hold the assembly in place.

The arm is apertured as at 46 (FIG. 6) at its centerline, a distance away from the axis of the shaft 28 equal to the distance that the spaced apertures 40A and 40B are away from the axis of the shaft 28.

It is thus possible for a pin 42 to be mounted in an aperture 40A or 40B so that it engages the side of the arm 18 to urge rotation of the arm about the axis of the shaft 28 in the same direction as the drive plate itself rotates but permits free rotation of the arm in the same direction when the drive shaft is stationary as will be understood subsequently.

Alternatively, the pin 42 may be mounted in either of the apertures 40A or 40B and extend through the aperture 46 to assure that the arm 18 rotates with the rotation of the drive plate 32.

The spacing between the apertures 40A and 40B is such that the arm 18 and the plate 32 are, when the door is closed, in the same relative positions irrespective of whether the pin is in aperture 40A and works against the side of the arm or is in aperture 40B and extends through aperture 46 in the arm. This assures that the force tending to close the door at the closed position will be uniform whether the device is in free swing or regular-closer mode. Obviously, the same condition applies with respect to both hands of operation.

Structurally described, the dimensions are such that the aperture 46 is on the centerline of the arm and the distance from the center of the aperture 46 to either side of the arm is equal to the distance from the center of one of the apertures 40A or 40B to the most adjacent surface of the pin 42 when installed in the other apertures 40B or 40A.

Figure 6:
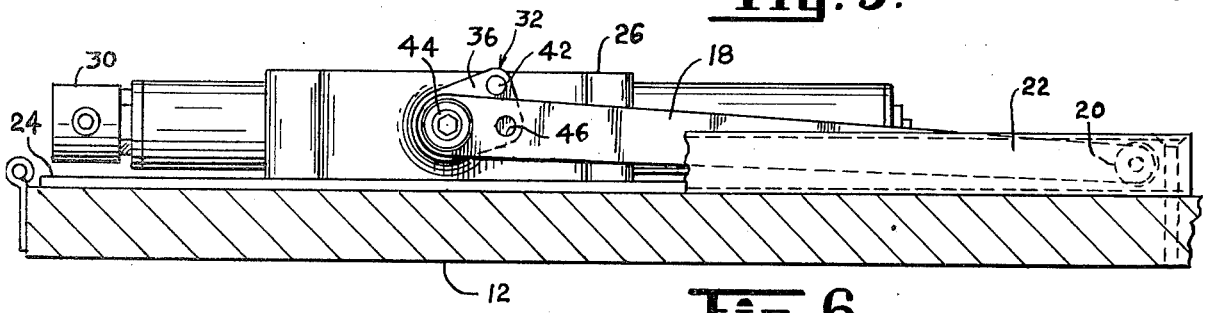
FIG. 6 is a sectional view taken on the line 6—6 of FIG. 5.

Thus, as shown in FIG. 6, when the door 12 is opened it causes the arm 18 to be rotated counterclockwise about the axis of the shaft 28. Because the pin 42 is on the leading side of the arm 18, as the door opens the rotation of the drive plate 32 is assured. However, when the door is in the open position and the door closer is "cocked", the arm 18 is free to move clockwise, the plate 32 remaining stationary because the pin 42 does not block such movement. Hence, the door in such a condition of the closer is free swinging.

Figure 7:
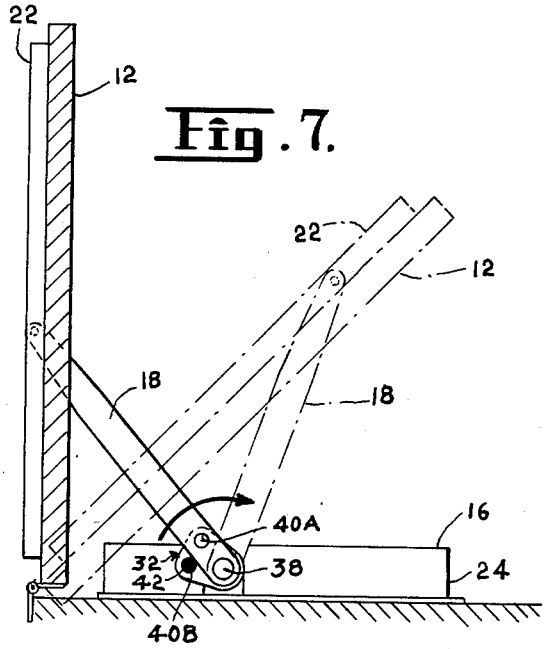
FIG. 7 is a view from the position of FIG. 6 but showing the closer and the door schematically, the closer being in free swing mode, the door being shown in open position in solid lines and in semi-open position in phantom.

Further referring to FIG. 7 which is taken from the same position as FIG. 6 (that is, looking up from the middle of the door) but on a smaller scale, it can be seen with the door open and the operator cocked, the door can be freely moved clockwise from the position shown to the phantom position without the impediment of the pin 42. Subsequently, when the door closer is actuated, the rotation of the drive plate (see arrow) will cause the pin 42 in aperture 40B as the plate rotates clockwise to encounter the arm 18 and cause the rotation of the arm 18 clockwise to close the door.

When it is desired to use a closer in a regular-closer mode (FIG. 9), the pin is inserted in the aperture 40A and received through the aperture 46 in the arm. This totally traps the arm so that its rotary movement is reflected in corresponding rotary movements of the drive plate and vice versa. Thus, in the FIG. 9 setup wherein the pin 42 extends through the aperture 46, there is no free-swing mode.

Figure 8:
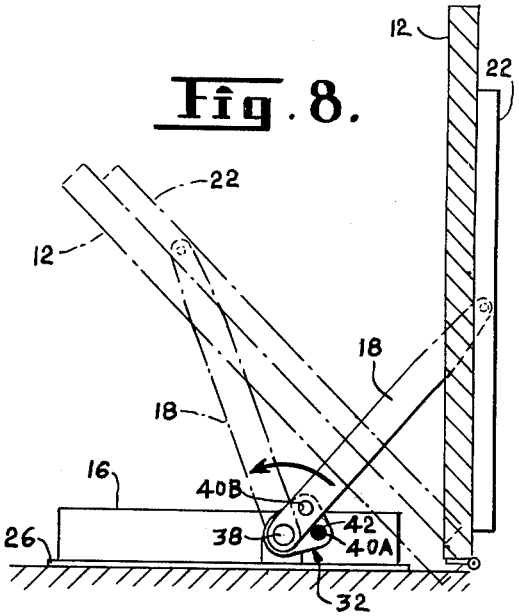
FIG. 8 is a view comparable to FIG. 7 but showing the closer of the invention installed on a door of different hand.
Figure 9:
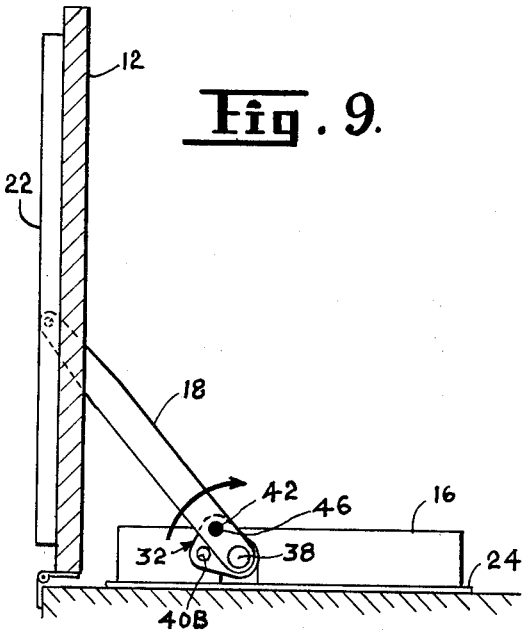
FIG. 9 is comparable to FIG. 7 which shows the operator in regular closer mode.
Figure 10:
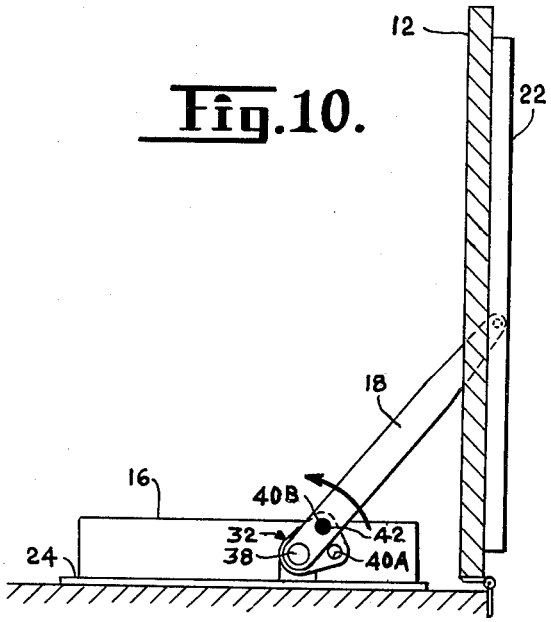
FIG. 10 is a view comparable to FIG. 9 but showing the closer installed in a door of different hand.

FIGS. 8 and 10 correspond to FIGS. 7 and 9 but show the drive plate as it would be mounted with the door whose hinges are on the right-hand side of the door trim. In such an arrangement, of course, the body 26 (FIG. 5) is inverted and the drive is taken from the other end of shaft 28. Thus in FIG. 8, the pin 42 in aperture 40A is mounted on the right-hand side of the arm 18 so that the opening of the door effects the cocking of the closer but subsequently permits free swinging of the door toward and away from the closed position. At the same time, should the closer be actuated, the counterclockwise rotation of the plate 32 (see arrow) will cause the eventual engagement of the pin 42 with the arm 18 and the prescribed closing by the closer.

In the FIG. 10 arrangement on the other hand, pin 42 mounted in aperture 40B extends through the aperture 46 on the arm 18 so that the plate and arm move together in either direction and a standard door closer mode is achieved.

From the above description, it will be seen that the present operating assembly is extremely simple and involves only the provision of a single new part, that is, the drive plate 32 including pin 42. Thus, because the arm is still basically a single rigid elongate member, the aesthetics of the new structure are excellent and it will be clear that by the provision of the plate 32 including pin 42 earlier closers of the type may be adapted for free-swing operation in either right or left-hand senses.

It should be understood that the invention has been described in only one form but is susceptible of various changes. Hence, the invention involved may take a number of forms, all of which are defined by the following claim language:

I claim:

1. An operator assembly for a door closer having a drive shaft comprising:

(a) an operator arm having means at one end to pivotally secure it to the drive shaft and means at the other end to secure it to the door, the arm having a first aperture spaced adjacent the said one end;

(b) a drive plate having means to rigidly secure it to the shaft in a plane perpendicular to the shaft and adjacent the arm, the plate having a pair of spaced apertures, the said spaced apertures and the first aperture being equidistant from the axis of the shaft;

(c) pin means adapted to be selectively received into one of the spaced apertures on the plate and selectively into the aperture on the arm or in abutting relation with a side of the arm adjacent the aperture on the arm.

2. An operator assembly as claimed in claim 1 wherein the pin means is removably secured in the selected aperture in the drive plate.

3. An operator assembly as claimed in claim 2 wherein the pin means is threaded and the spaced apertures are tapped.

4. An operator assembly as claimed in claim 1 wherein the first aperture is on the centerline of the arm and the distance from the center of the first aperture to either side of the arm is equal to the distance from the center of either of the spaced apertures to the most adjacent surface of the pin means when installed in the other of the spaced apertures.

5. In a door closer and hold-open device comprising a body, a drive shaft rotatably mounted in the body and extending out of the body, an operating arm removably secured at one end to the shaft, a drive plate fixedly attached to the shaft, the drive plate in turn operatively engaging the operating arm, the closer being mounted on one of a door or a frame, the distal end of the operating arm being connected to the other of said door or frame; connecting means connecting the plate and the operating arm whereby the shaft normally urges the door closed; the improvement wherein the drive plate is disposed parallel to the operating arm and thereagainst and the connecting means is a pin extending out from the plate in the direction of the arm on the opposite side of the arm from the door and normally engaging said side of the arm, and means to selectively hold the shaft from rotation when the door is open, whereby the door may be freely swung when the shaft is so held.

6. A door closer and hold-open device as claimed in claim 5 wherein the pin is threadedly received in an aperture in the plate.

* * * * *